US005902942A

United States Patent [19]

Maderud et al.

[11] Patent Number: 5,902,942

[45] Date of Patent: May 11, 1999

[54] ROLL FOR HOT ROLLING WITH INCREASED RESISTANCE TO THERMAL CRACKING AND WEAR

[75] Inventors: Carl-Johan Maderud, Stockholm; Thomas Ericson, Hägersten; Udo Fischer, Vällingby, all of Sweden

[73] Assignee: Sandvik AB, Sandviken, Sweden

[21] Appl. No.: 08/885,350

[22] Filed: Jun. 30, 1997

[30] Foreign Application Priority Data

Jul. 19, 1996 [SE] Sweden ..... 9602810

[51] Int. Cl.[6] ..... C22C 29/08

[52] U.S. Cl. ..... 75/240; 419/18; 419/32; 419/33; 419/35; 419/43

[58] Field of Search ..... 75/240; 419/18, 419/32, 33, 35, 43

[56] References Cited

U.S. PATENT DOCUMENTS

| | | | |
|---|---|---|---|
| 3,993,446 | 11/1976 | Okawa . | |
| 4,820,482 | 4/1989 | Fischer et al. | 419/15 |
| 5,235,879 | 8/1993 | Drougge | 83/13 |
| 5,305,840 | 4/1994 | Liang et al. | 175/426 |
| 5,403,652 | 4/1995 | Drougge | 428/216 |
| 5,418,049 | 5/1995 | Drougge | 428/215 |
| 5,441,693 | 8/1995 | Ederyd et al. | 419/10 |
| 5,505,902 | 4/1996 | Fischer et al. | 419/10 |
| 5,529,804 | 6/1996 | Bonneau et al. | 427/217 |
| 5,619,000 | 4/1997 | Ederyd et al. | 75/240 |

FOREIGN PATENT DOCUMENTS 2 036 620 7/1992 United Kingdom .

OTHER PUBLICATIONS

Patent Abstracts of Japan, vol. 096, No. 007, Jul. 31, 1996,, & JP 08 073964 A (Hitachi Metals Ltd), Mar. 19, 1996.

Rhodes, M.J., editor, "Principles of Powder Technology", John Wiley & Sons, Chichester, England, 1990, pp. 259–263.

*Primary Examiner*—Ngoclan Mai

*Attorney, Agent, or Firm*—Burns, Doane, Swecker & Mathis, L.L.P.

[57] ABSTRACT

There is now provided a roll for hot rolling comprising 70–95 weight %, preferably 85–94 weight %, WC in a binder phase consisting of only cobalt or alternatively a Co—Ni—Cr alloy containing 20–35 weight % Ni and up to 10 weight % Cr, possibly with small additions of molybdenum. The WC grains are rounded with an average grain size between 3–10 μm, preferably 4–8 μm. The maximum grain size should not exceed 2 times the average grain size and no more than 2% of the grains be less than half of the average grain size.

3 Claims, 1 Drawing Sheet

ROLL FOR HOT ROLLING WITH INCREASED RESISTANCE TO THERMAL CRACKING AND WEAR

BACKGROUND OF THE INVENTION

The present invention relates to cemented carbide rolls for hot rolling of steel wire and rod. These rolls are made from cemented carbide grades containing WC and a binder phase of either Co or an alloy of Co+Ni or Co+Ni+Cr.

One of the main advantages of using cemented carbide for rolls for hot rolling compared to rolls made of cast iron, steel or high speed steel, is the lower surface temperature of the cemented carbide roll as a result of the excellent heat conductivity of cemented carbide. This delays the initiation of thermal cracks and decreases the abrasive wear in the passform which is the groove shaped part of the roll which comes in contact with the hot stock. It will also reduce the fatigue from the thermal cycling of the roll. Altogether, cemented carbide rolls often have a passform life 10–20 times that of rolls made of other materials. This has lead to a widespread use of cemented carbide rolls for hot rolling of wire, bar and profiles.

The thermal conductivity of cemented carbide is inversely proportional to the content of binder phase. This is due to the higher thermal conductivity of tungsten carbide compared to the binder phase. When the binder phase content is increased, more heat transportation takes place in the binder phase due to reduced carbide/carbide interface area.

When choosing a composition for certain hot roll applications, it is often a balancing of the need for a tough material withstanding the mechanical stress with the need to minimize the binder phase content to get a material with as high heat conductivity as possible to withstand the formation of thermal cracks and thermal fatigue and to get as long passform life as possible without increasing the risk of cracking due to mechanical overload.

The high mechanical stress with a lot of blows from the cold ends of the hot stock being fed into the roll and high separating forces, has lead to the use of cemented carbide grades with hardness values ranging from 600 to 1250 $HV_3$ and cobalt contents from 10% to 30% by weight. In order to maintain such low hardness values, it has been necessary to use as coarse grained grades as possible, to be able to reduce the binder phase content without increasing the hardness and thus reducing the toughness of the material.

Cemented carbide is made by powder metallurgical methods comprising wet milling a powder mixture containing powders forming the hard constituents and binder phase, drying the milled mixture to a powder with good flow properties, pressing the dried powder to bodies of desired shape and finally sintering.

The intensive milling operation is performed in mills of different sizes using cemented carbide milling bodies. Milling is considered necessary in order to obtain a uniform distribution of the binder phase in the milled mixture. It is believed that the intensive milling creates a reactivity of the mixture which further promotes the formation of a dense structure during sintering. The milling time is in the order of several hours up to days.

The microstructure after sintering of a material manufactured from a milled powder is characterized by sharp angular WC grains with a rather wide WC grain size distribution, often with relatively large grains, which is a result of dissolution of fine grains, recrystallization and grain growth during the sintering cycle.

In U.S. Pat. Nos. 5,505,902 and 5,529,804, methods of making cemented carbide are disclosed according to which the milling is essentially excluded. Instead, in order to obtain a uniform distribution of the binder phase in the powder mixture, the hard constituent grains are precoated with the binder phase, the mixture is further mixed with a pressing agent, pressed and sintered. In the first mentioned patent, the coating is made by a SOL-GEL method and in the second, a polyol is used. When using these methods, it is possible to maintain the same grain size and shape as before sintering due to the absence of grain growth during sintering.

OBJECTS AND SUMMARY OF THE INVENTION

It is an object of this invention to avoid or alleviate the problems of the prior art.

It is further an object of this invention to provide unique cemented carbide rolls for hot rolling of steel wire and rod and methods of making the same.

In one aspect of the invention there is provided a roll for hot rolling comprising 70–95 weight % WC in a binder phase of only cobalt or a Co—Ni—Cr alloy containing 20–35 weight % Ni, up to 10 weight % Cr and up to 5 weight % molybdenum, the WC grains being rounded with an average grain size between 3–10 $\mu$m, the maximum grain size not exceeding 2 times the average grain size and no more than 2% of the grains being less than half of the grain size.

In another aspect of the invention there is provided a method of making a roll for hot rolling comprising 70–95 weight % WC with an average grain size between 3–10 $\mu$m, comprising jetmilling with or without sieving a WC powder to a powder with narrow grain size distribution in which the fine and coarse grains are eliminated, wet mixing the WC powder to a slurry with powders forming the binder phase to obtain the desired final composition along with a pressing agent and thickeners to form a uniform mixture without milling, drying the slurry by spray drying, pressing rolls from the spray dried powder and sintering.

DETAILED DESCRIPTION OF THE PREFERRED EMBODIMENTS OF THE INVENTION

Figure 1:
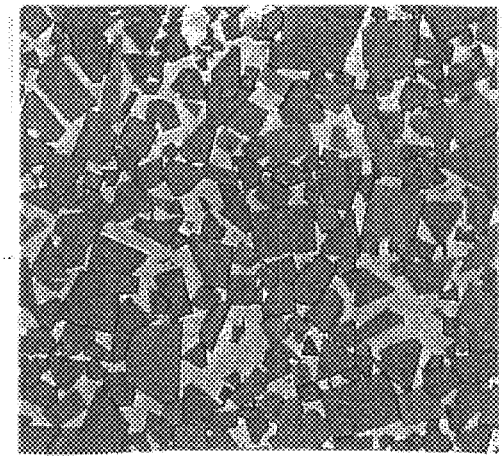
FIG. 1 is a photomicrograph showing the microstructure in 1200X of a prior art cemented carbide roll.

It has now surprising turned out that cemented carbides manufactured with the processes of U.S. Pat. Nos. 5,505,902 and 5,529,804 have improved mechanical, thermal and fatigue properties resulting in improved performance for rolls for hot rolling. In the resulting materials, the contiguity of the WC skeleton is higher than for materials manufactured from a milled powder, with the same content of binder phase and hardness, the only difference being the different structures resulting from pronounced recrystallization and grain growth during sintering in the milled powder. A higher contiguity of the WC skeleton achieved by a different behavior during sintering will lead to a higher thermal conductivity in the body. Since a more continuous and rigid WC skeleton is created, one can also anticipate increased strength. The more narrow grain size distribution and the absence of very coarse WC grains, thanks to the controlled sintering process, will also lead to improved resistance against both initiation and propagation of cracks.

According to the invention, there is now provided a roll for hot rolling comprising 70–95 weight %, preferably 85–94 weight %, WC in a binder phase consisting of only cobalt or alternatively, a Co—Ni—Cr alloy containing 20–35 weight % Ni and up to 10 weight % Cr, possibly with additions of molybdenum up to 5 weight %. The WC grains are rounded with an average grain size between 3–10 μm, preferably 4–8 μm. The maximum grain size should not exceed 2 times the average grain size, nor must more than 2% of the grains found in the structure be under the half of the average grain size.

In a preferred embodiment, the composition should be about 87% WC with 13% of a Co-based binder phase containing 32 weight % Ni (% of the binder phase) and 8 weight % Cr (% of the binder phase) and a WC average grain size of 4.5 μm. The contiguity, C, >0.5 being determined by lineal analysis $$C = \frac{2 \cdot N_{WC/WC}}{2 \cdot N_{WC/WC} + N_{WC/binder}}$$

where $N_{WC/WC}$ is the number of carbide/carbide and $N_{WC/binder}$ is the number of carbide/binder boundaries per unit length of the reference line.

According to the method of the present invention, a roll for hot rolling is manufactured by jetmilling with or without sieving a WC powder to a powder with narrow grain size distribution in which the fine and coarse grains are eliminated. Preferably, this WC powder is then coated with Co according to one of U.S. Pat. Nos. 5,505,902 and 5,529,804 which are both herein incorporated by reference. The WC powder is then carefully wet mixed to a slurry with powders forming the binder phase to the desired final composition and a pressing agent. Furthermore, in order to avoid sedimentation of the coarse WC particles, thickeners can, if desired, be added according to Swedish patent application 9702154-7. The mixing shall be such that a uniform mixture is obtained without milling, i.e., no reduction in grain size shall take place. The slurry is dried by spray drying. From the spray dried powder, a roll is pressed and sintered according to standard practice.

The invention is additionally illustrated in connection with the following Example which is to be considered as illustrative of the present invention. It should be understood, however, that the invention is not limited to the specific details of the Example.

EXAMPLE

Two sets of cemented carbide rolls for hot rolling with a diameter of 158 mm and 65 mm wide were manufactured. The cemented carbide had an average WC grain size of 4.5 μm and 13% binder phase with the composition 60 weight % cobalt, 32 weight % nickel and 8 weight % chromium. The hardness for both materials was about 1000 $HV_3$.

Variant A: Powders of WC, Co, Ni and Cr in amounts to obtain the desired composition were milled, dried, pressed and sintered. The rolls had a microstructure according to FIG. 1.

Figure 2:
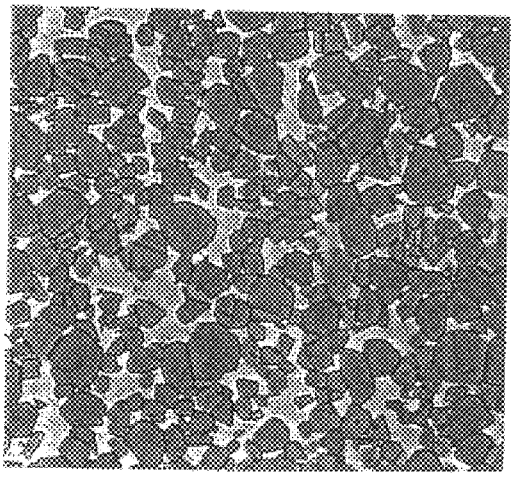
FIG. 2 is a photomicrograph showing the microstructure in 1200XBVGFG of a cemented carbide roll of the present invention.

Variant B: WC powder was jetmilled/classified to a grain size in the interval 2–9 μm. This WC powder was coated with cobalt by the method disclosed in U.S. Pat. No. 5,505,902, resulting in a WC powder with about 2 weight % Co. This powder was carefully mixed without milling with powders of Co, Ni and Cr to obtain the desired final composition and pressing agent. After drying, the powder was compacted and sintered. A microstructure according to FIG. 2 was obtained.

The contiguity of both variants was determined with the following result:

| Variant | Contiguity |
|---|---|
| A - prior art | 0.43 |
| B - according to the invention | 0.53 |

From test bars of the two variants, the transverse rupture strength was determined with the following result:

| Variant | Transverse Rupture Strength (MPa) | Standard Deviation % |
|---|---|---|
| A - prior art | 1950 | 5.5 |
| B - according to the invention | 2250 | 3.3 |

It is evident that the transverse rupture strength for a material according to the invention was improved compared to a material of the same composition and hardness produced by the prior art technique. The standard deviation of obtained values was more narrow. This indicates that this is a material with more narrow properties compared to a material produced by the normal milling route.

The rolls were run in a mill rolling stainless wire (predominantly grade AISI 316 L) with a final diameter of 5.6 mm. The rolls were given an oval shaped passform and were set up in the first stand in the finishing block where the stock velocity was approximately 40 m/s and the reduction 20%. The surface temperature of the hot stock in this particular stand was about 950° C.

Figure 3:
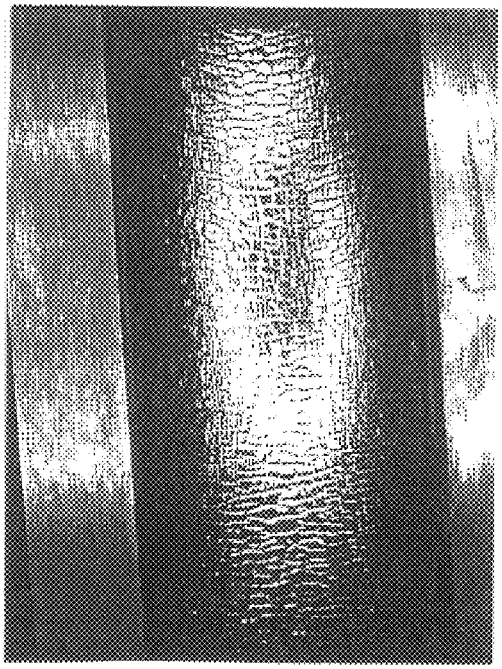
FIG. 3 is a photograph showing the wear pattern of the passform of a prior art cemented carbide roll after a period of use.

Results:

Variant A: After 1200 tons, the passform had a severe thermal crack pattern, see FIG. 3, and was reground with a depth of 0.6 mm to remove all cracks.

Figure 4:
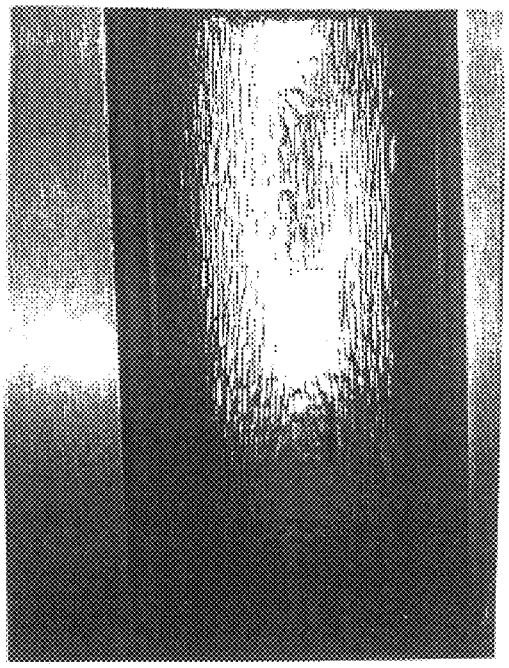
FIG. 4 is a photograph showing the wear pattern of the passform of a cemented carbide roll of the present invention after the same period of use.

Variant B: After 1200 tons, no thermal crack pattern was visible, see FIG. 4, only normal wear was visible. After 1800 tons, a light thermal crack pattern was visible in the passform, and the passform was reground with a depth of 0.4 mm.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A roll for hot rolling having a composition of about 87% WC, with a Co-based binder phase containing 32 weight % Ni and 8 weight % Cr, the WC grains being rounded with an average grain size of 4.5 μm, the maximum grain size not exceeding 2 times the average grain size and no more than 2% of the grains being less than half of the grain size and with a contiguity, C, >0.5 being determined by lineal analysis as $$C = \frac{2 \cdot N_{WC/WC}}{2 \cdot N_{WC/WC} + N_{WC/binder}}$$

where $N_{WC/WC}$ is the number of carbide/carbide and $N_{WC/binder}$ of carbide/binder boundaries per unit length of the reference line.

2. A method of making a roll for hot rolling comprising 70–95 weight % WC with an average grain size between 3–10 $\mu$m, comprising jetmilling with or without sieving a WC powder to a powder with grain size distribution in which the fine and coarse grains are eliminated, the WC grains being rounded with an average grain size between 3–10 $\mu$m, the maximum grain size not exceeding 2 times the average grain size and no more than 2% of the grains being less than half of the grain size, wet mixing the WC powder to a slurry with powders forming the binder phase to obtain the desired final composition along with a pressing agent to form a uniform mixture without milling, drying the slurry by spray drying, pressing rolls from the spray dried powder and sintering.

3. The method of claim 2 comprising coating the WC powder with Co prior to the mixing.

* * * * *